US005697540A

United States Patent [19]

Bridgman

[11] Patent Number: 5,697,540

[45] Date of Patent: Dec. 16, 1997

[54] FEED MECHANISM FOR ADVANCING ELONGATED STRIP MATERIAL

[75] Inventor: Michael A. Bridgman, Holmer Green, England

[73] Assignee: Thomas & Betts Corporation, Memphis, Tenn.

[21] Appl. No.: 378,168

[22] Filed: Jan. 25, 1995

[51] Int. Cl.[6] ..... B65H 23/06; B65H 23/16

[52] U.S. Cl. ..... 226/34; 226/150

[58] Field of Search ..... 226/32, 34, 115, 226/141, 150, 162

[56] References Cited

U.S. PATENT DOCUMENTS

| | | | |
|---|---|---|---|
| 3,186,047 | 6/1965 | Schwester et al. | 24/16 |
| 3,408,699 | 11/1968 | Reynolds | 24/16 |
| 3,588,961 | 6/1971 | Farago | 24/16 |
| 3,713,571 | 1/1973 | Simonton | 226/32 |
| 3,726,458 | 4/1973 | Rabl | 226/141 |
| 3,875,618 | 4/1975 | Schuplin | 24/16 |
| 4,124,156 | 11/1978 | Waffner | 226/34 |
| 4,493,447 | 1/1985 | Ledgerwood | 226/162 |
| 4,597,516 | 7/1986 | Mayhall, Jr. et al. | 226/34 |
| 4,611,705 | 9/1986 | Fluck | 198/425 |
| 4,671,722 | 6/1987 | Ray et al. | 414/32 |
| 5,121,524 | 6/1992 | Mortensen | 24/16 |

FOREIGN PATENT DOCUMENTS

| | | | |
|---|---|---|---|
| 428830 | 10/1974 | U.S.S.R. | 226/32 |
| 1186830 | 4/1970 | United Kingdom . | |
| 1260661 | 1/1972 | United Kingdom | 226/162 |

*Primary Examiner*—Daniel P. Stodola
*Assistant Examiner*—Matthew A. Kaness
*Attorney, Agent, or Firm*—Michael L. Hoelter; Salvatore J. Abbruzzese

[57] ABSTRACT

A feed mechanism for advancing an elongate strip of material including a pilot mechanism for locating the strip such that flexure regions of the strip are disposed at a predetermined position relative to the feed mechanism. The mechanism advances the strip a distance corresponding to the spacing between flexure regions. A control device is included for operating the pilot mechanism and the advancing device alternately such that before each advancement the strip is located with its flexure regions in the predetermined position relative to the feed mechanism.

1 Claim, 6 Drawing Sheets

FEED MECHANISM FOR ADVANCING ELONGATED STRIP MATERIAL

FIELD OF THE INVENTION

The invention relates to strip feed mechanisms, particularly cable tie strip feed mechanisms which require accurate strip feed in incremental steps in order to advance a strip a predetermined amount.

BACKGROUND OF THE INVENTION

In a strip feed mechanism for a wire strip into a machine for cutting short lengths of strip to make barbs for insertion into cable tie heads, the wire strip has hitherto been a plain, flat steel wire strip. Because the cross section of the wire strip was constant, it was possible to use a simple feed mechanism in which the strip is driven forward by a slipping clutch drive into a stop such that when the strip reached the stop, a required length was cut from the free end of the strip to form the barb, which was then inserted into the cable tie head.

In order to improve the cable tie performance, alternative barbs have been proposed as illustrated in U.S. Pat. No. 3,408,699 in which each barb has a flexure region at a desired position along its length, the flexure region being designed to reduce the resistance of the barb to flexure in that region and thereby ease insertion of a strap portion of the cable tie through the tie head in use.

However, introduction of flexure regions into each barb length on a continuous wire strip causes a feed problem if the existing slipping clutch feed is used. This problem arises because the slipping clutch feed mechanism causes the distance the strip advances each time a barb is cut and removed to be the length of the strip cut to form that barb. If the barb length cut each time is not exactly the same as the spacing between flexure regions along the strip length, there will be a gradual alteration in the position of the flexure region of barbs as time goes on. For example, if the spacing between flexure regions were less than lengths of barb cut the flexure region would move progressively towards the front edge of the barb as more barbs are cut from the strip. It is impractical and time wasting to control and check the barb length being cut, and an alternative approach was required in order to overcome this problem.

SUMMARY OF THE INVENTION

According to the invention, there is provided a feed mechanism for advancing in steps an elongate strip of material, which strip has a series of flexure regions at a regular spacing along its length, the feed mechanism comprising means for locating the strip such that the flexure regions are at a predetermined position relative to the feed mechanism, means for advancing the strip by a distance corresponding to the spacing between flexure regions and control means for operating the locating means and the advancing means alternatively such that before each advancement the strip is located with the flexure regions in such predetermined position relative to the feed mechanism.

The strip material is preferably metal, and preferably stainless steel.

Each flexure region is preferably provided by a portion of reduced strip width and the means for locating the strip comprises pilot means for engaging the profile which defines the portion of reduced strip width. The pilot means preferably comprises a pilot pin having an end profile corresponding to the profile defining the portion of reduced strip width. The end profile of the pilot pin is preferably tapered to allow entry of the pilot pin into the profile of the reduced strip width portion and adjustment of the strip location as the pilot pin engages the strip fully. It will be appreciated that each flexure region may be provided by forming one or more holes in the strip, by forming one or more edge cut-out portions, or by otherwise reducing the cross-sectional area of the strap.

It is possible that if the strip is too far out of position relative to the mechanism, the pilot pin cannot start to enter the profile of reduced width to locate the strip. Preferably, there is provided sensor means for sensing pilot pin travel and means for stopping the feed mechanism if pilot pin travel is incomplete. The sensor means preferably comprises a sensor for generating an electrical signal when the pilot pin is at a position intermediate a fully disengaged position and a position fully engaged with the strip, and a timer in the circuit such that if the length of signal from the sensor exceeds a predetermined time, the circuit is broken to switch off the mechanism.

BRIEF DESCRIPTION OF THE DRAWING

By way of example, one embodiment of a feed mechanism according to the invention will now be described to the accompanying drawings, in which.

DETAILED DESCRIPTION OF THE PREFERRED EMBODIMENTS

Figure 2:
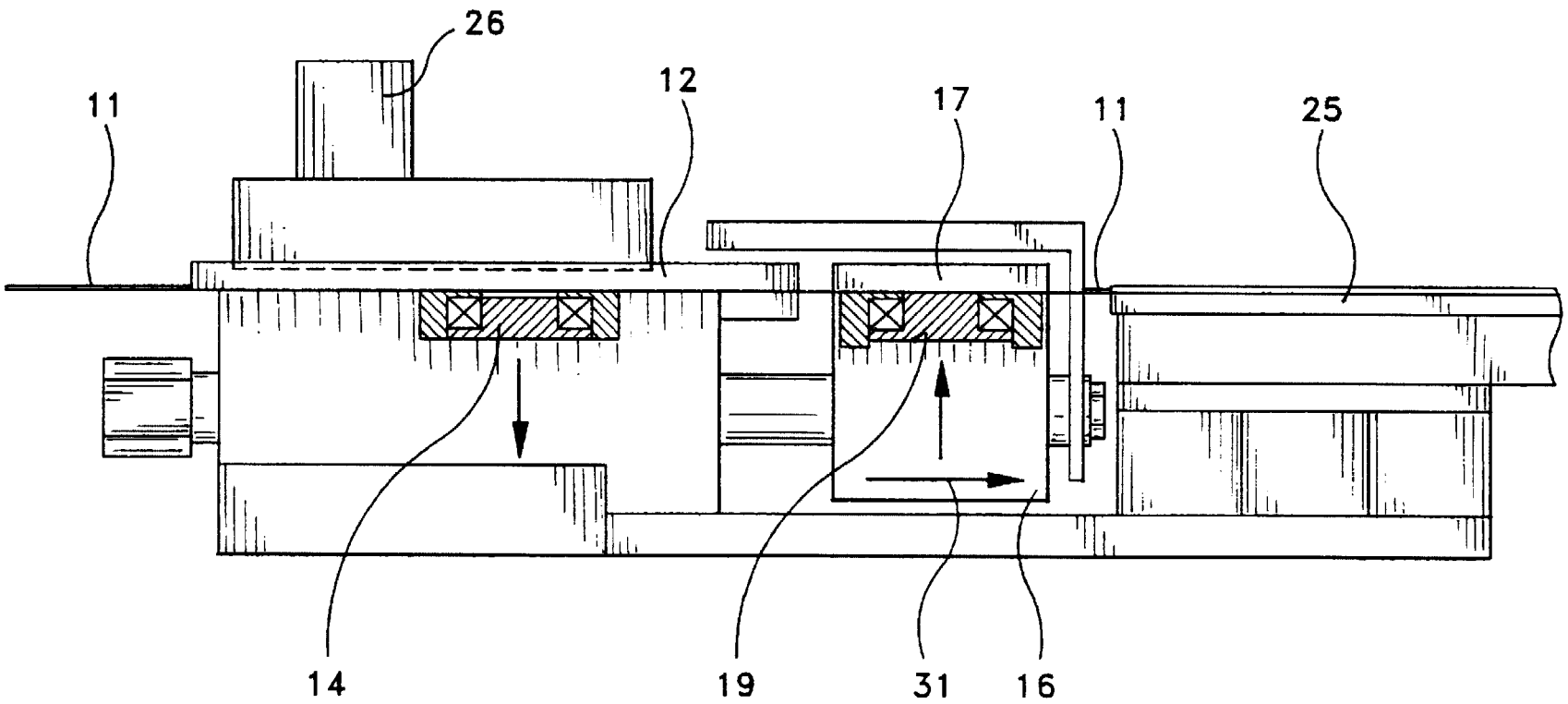
FIG. 2 is a side view, partly in section, of the mechanism of FIG. 1 in a second position.
Figure 3:
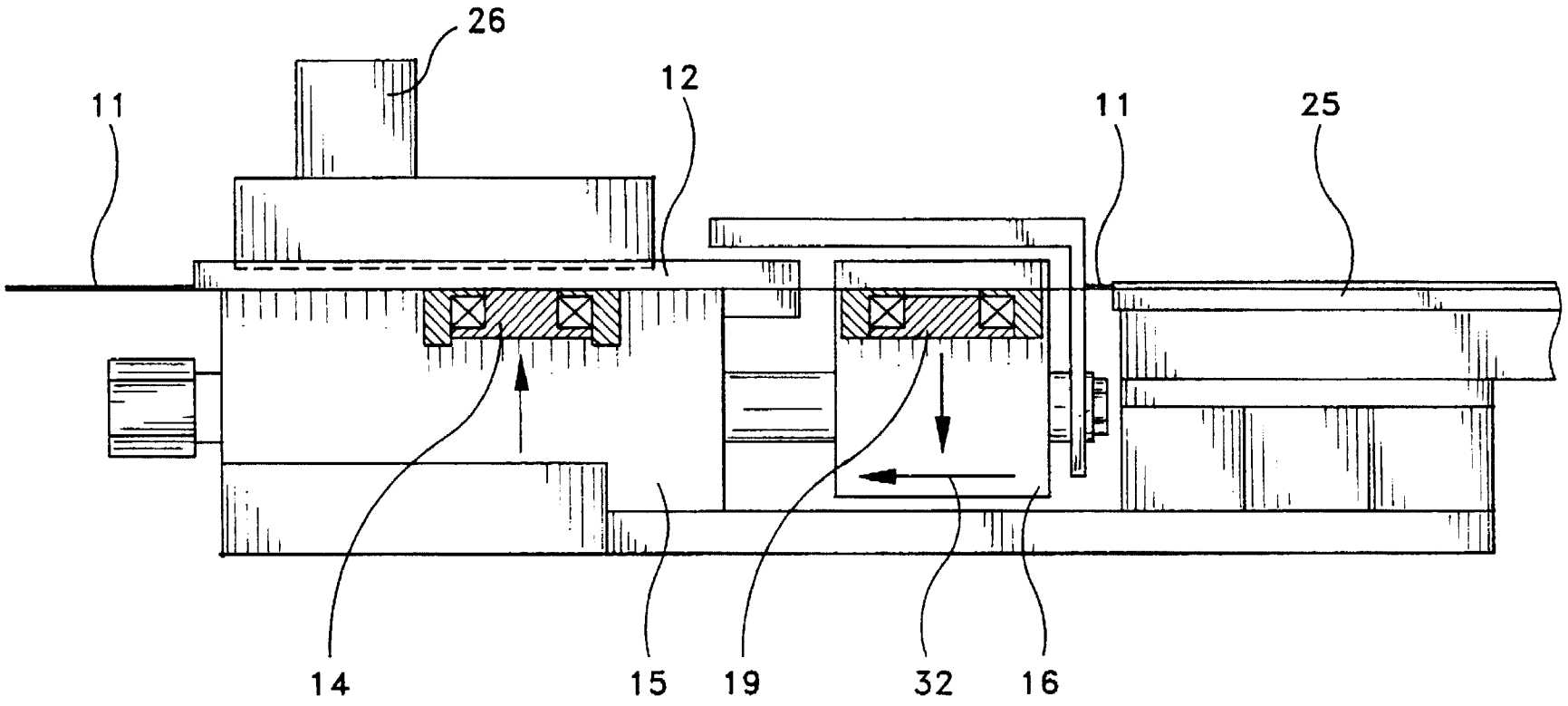
FIG. 3 is a side view, partly in section, of the mechanism of FIG. 1 in a third position.

Referred first to FIGS. 1 to 3, the sequence of operation of a strip feed mechanism 10 will be described.

The strip feed mechanism 10 forms part of a barb cutting and insertion machine which has a cutter for cutting a required barb length and means for driving a barb into a cable tie head. The present invention is not concerned with barb cutting and insertion features and, for this reason, those features will not be described herein. This invention is concerned with accurate step advancement of a flat wire strip 11 into the barb cutting and inserting machine, the strip 11 having regularly spaced flexure regions along its length.

The strip 11 is fed from a reel or other suitable store into the strip feed mechanism 10, passing first under a guide block 12 and over a holding piston assembly 13, the holding piston assembly 13 having a holding piston 14 which can be moved towards or away from the block 12 to hold or release the strip 11. The holding piston assembly 13 is mounted on a main block 15 which serves also to support the guide block 12.

Slidably mounted on the main block 15 is a shuttle 16, the shuttle 16 having a shuttle strip guide 17 below which the strip 11 passes and a gripping mechanism 18 including a piston 19 mounted movably towards and away from the shuttle strip guide 17. The shuttle 16 is fixedly mounted on a bar 20 movable through the main block 15 and controlled pneumatically as described later in this specification.

From the shuttle, the strip 11 passes forward on a support track 25 leading to the barb cutting and inserting mechanism.

Above the guide block 12 is mounted a pilot mechanism 26 which includes a pneumatically controlled pilot pin which can be moved into and out of engagement with profiles on the strip 11 which provide the flexure regions of the strip. Particular configurations of the flexure regions and the pilot pin 40 will be described later.

The sequence of operation of an advancement cycle is as follows:

1. FIG. 1 illustrates the start of a cycle with arrow 30 illustrating that the pilot pin is down to engage one or more flexure region profiles of the strip 11. The purpose of the pilot pin engagement is to ensure at the start of the cycle that the strip 11 is located with it flexure regions at a predetermined position relating to the main block 15 and hence the barb cutting and insertion mechanism, thereby ensuring that the next barb to be cut has it flexure region at the required position along it length. In the position shown in FIG. 1, the pistons 14 and 19 are released, thereby allowing adjustment of the position of the strip 11 relative to the block 15 as the pilot pin engages the profiles providing flexure regions on the strip 11.
2. The pilot pin is raised and withdrawn from engagement with the strip 11, at which time the shuttle piston 19 is raised to clamp the strip 11 between the piston 19 and shuttle strip guide 17. The shuttle 16 is then advanced in a direction shown by arrow 31 in FIG. 2; FIG. 2 shows an intermediate position of the shuttle 16.
3. When the shuttle 16 has advanced the strip 11 a required amount, set by a mechanical stop on the shuttle 16, the piston 19 is released from clamping the strip 11 to the shuttle strip guide block 17 and the piston 14 in the main block 15 is raised to clamp the strip 11 to the strip guide block 12. The shuttle is then returned towards the main block 15, as indicated by arrow 32 in FIG. 3 until the cycle is started again the in the position shown in FIG. 1.

Figure 4A:
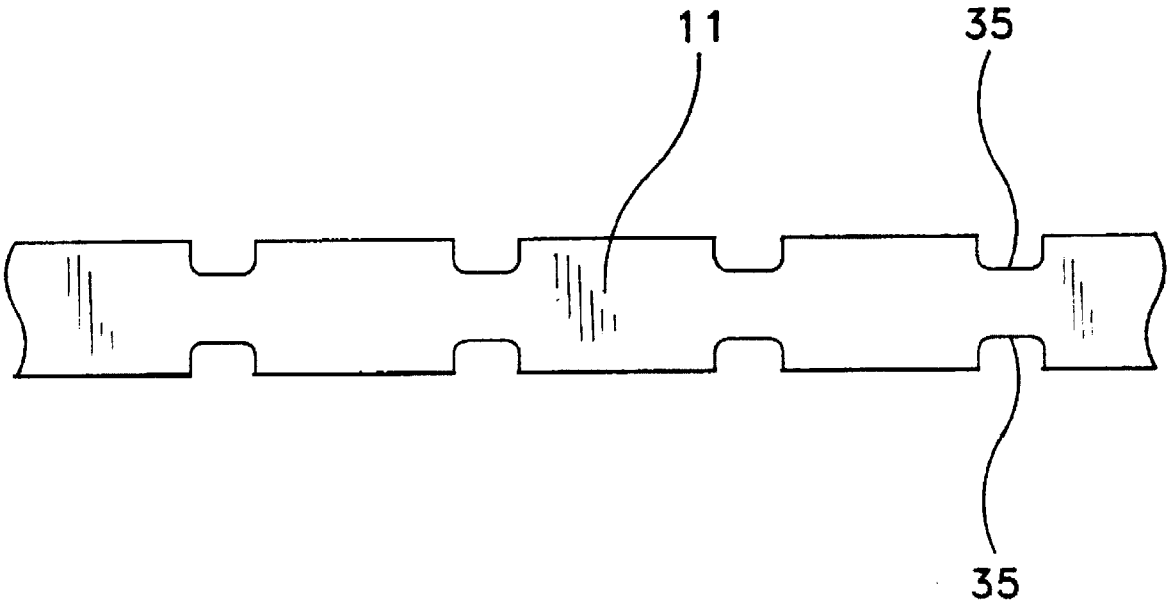
FIG. 4*a* is a plan view of part of a strip.

FIG. 4*a* illustrates a portion of the strip 11, preferably made of steel, and having opposed cut-out portions 35 formed in the strip edges. The cut-out portions are formed by a stamping operation although there are other ways of forming this edge profile. The cut-out portions 35 provide a flexure region between them because the width of the strip has been reduced, thereby making flexure easier into and out of the plane of the strip represented by the plane of FIG. 4*a*. Each barb has one such flexure region in it.

Figure 4B:
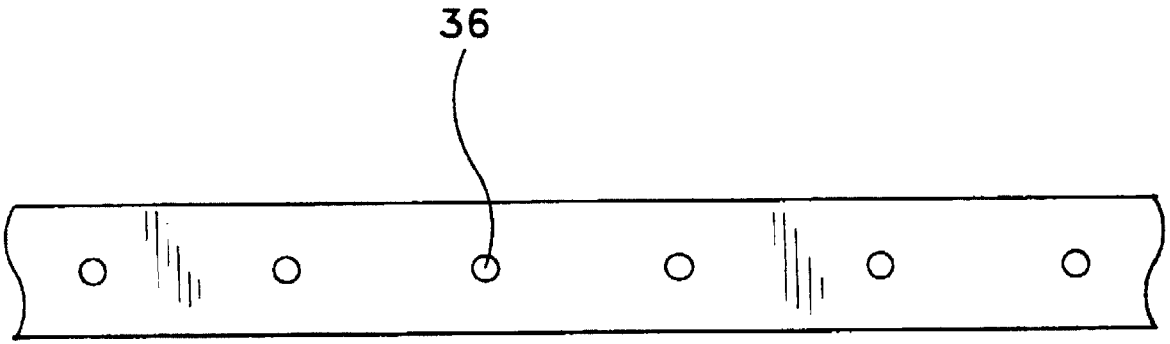
FIG. 4*b* is a plan view of an alternative embodiment of a strip.

It will be appreciated that there are alternative profiles which would produce a similar flexure region. FIG. 4*b* shows a flexure region formed by stamping a series of holes 36 at regular intervals. Further alternative shapes could be used in order to achieve a flexure region.

Figure 6:
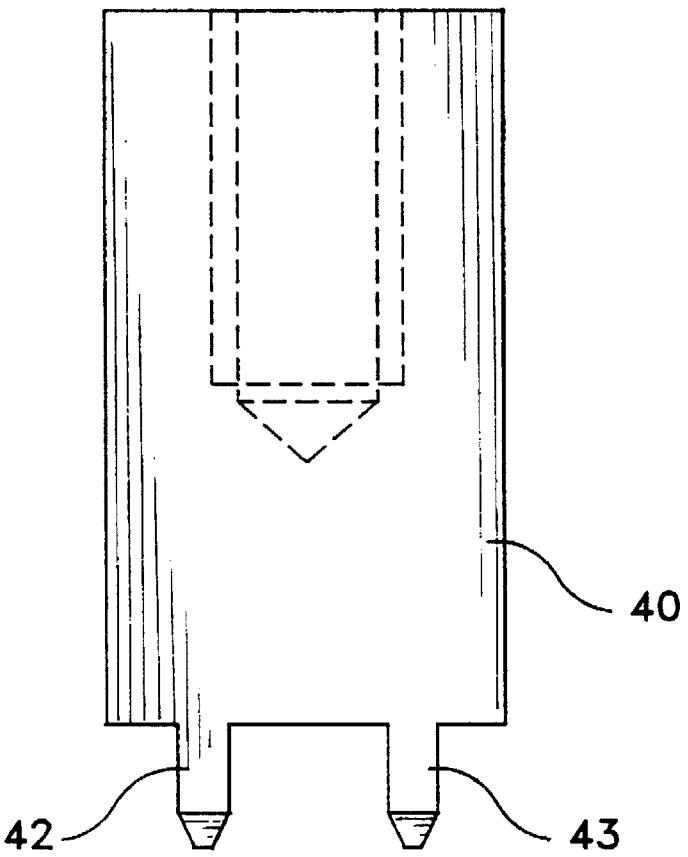
FIG. 6 is an enlarged side view of the pilot pin.
Figure 5:
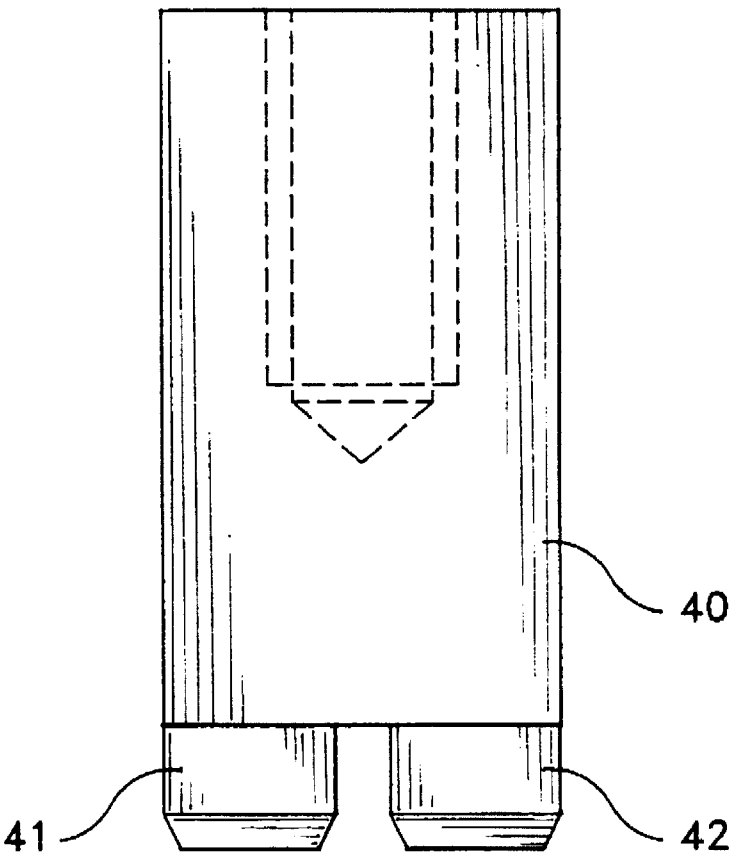
FIG. 5 is an enlarged front view of a pilot pin.

The pilot pin of the pilot mechanism 26 is shown enlarged in FIGS. 5 and 6. FIG. 5 is a front view and shows a main pilot pin body 40 and strip edge cut-out engaging fingers 41, 42. A side view of the pin is shown in FIG. 6 in which the finger 42 and a further finger 43 can be seen. It will be appreciated that there are four fingers in all. The pilot pin is driven toward the strip 11 by pilot mechanism 26 such that the fingers 41,42 pass through the strip edge cutout portions 35 thereby engaging strip 11. The fingers 41, 42, 43 and 44 (44 is not shown) have tapered ends to allow engagement of the fingers with the cut-out portions 35 of the strip 11 even if alignment of the strip with the pilot pin is not perfect. As the pin descends, the position of the strip 11 is adjusted accordingly until full engagement takes place.

It will be appreciated that the pilot pin will be changed according to the nature of the flexure region profiles of the strip 11. For example, in order to engage the holes 36 of the strip of FIG. 4*b*, the pilot pin would have a pair of spaced apart, tapered fingers of circular cross section.

The strip feed mechanism is operated pneumatically, although alternative control mechanisms could be used. The pneumatic circuit used is illustrated in FIG. 7 and will be described in more detail below.

The pneumatic circuit has four valves, shown as V1, V2, V3 and V4; to an inlet port of each of V1, V3 and V4 is connected a compressed air supply 50, via lines 51, 52, 53 respectively. Valve switching is controlled electrically for V1 and V4 and pneumatically for V2 and V3.

Figure 1:
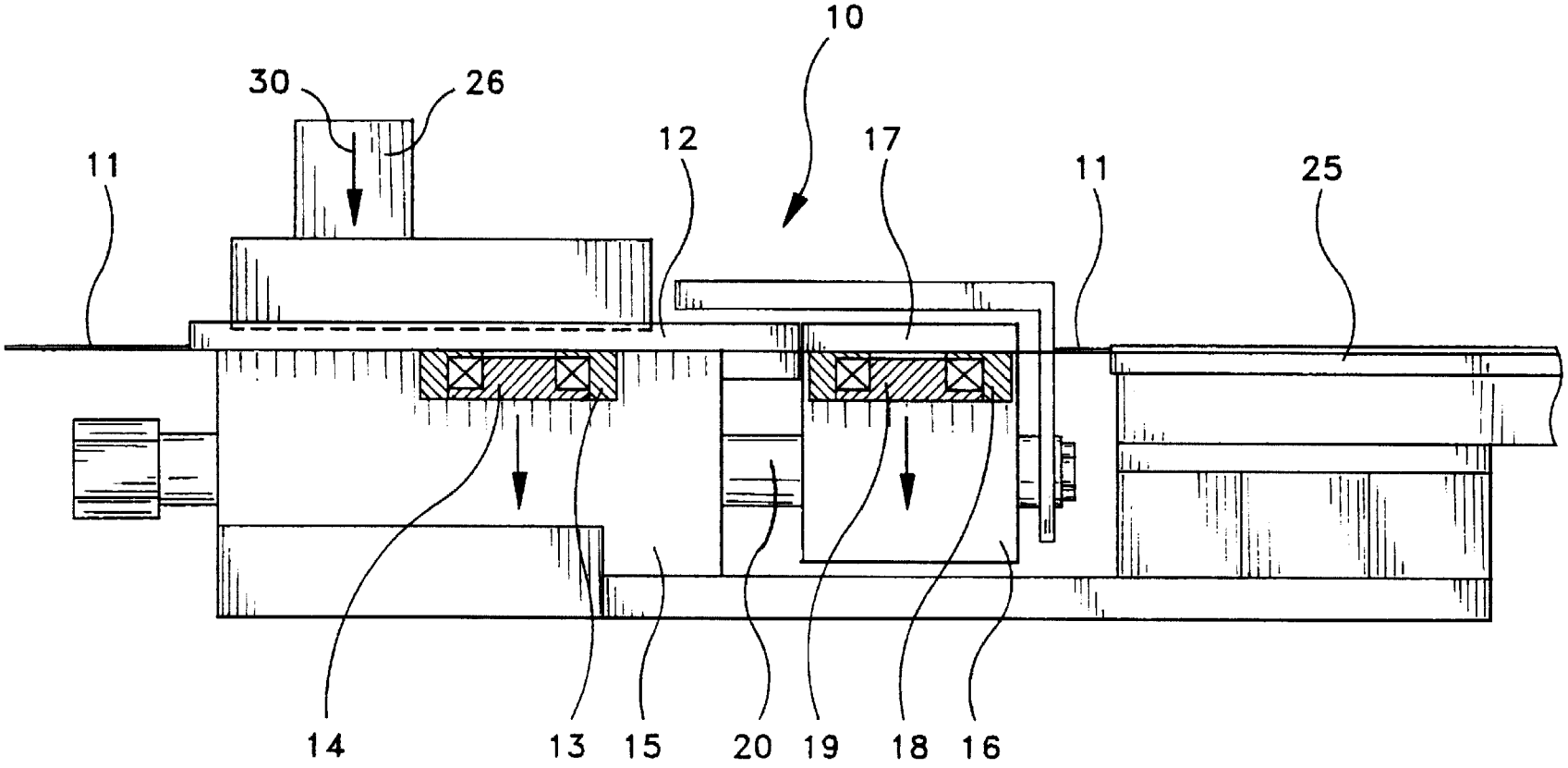
FIG. 1 is a side view, partly in section, of a strip feed mechanism according to the invention in the first position.
Figure 7:
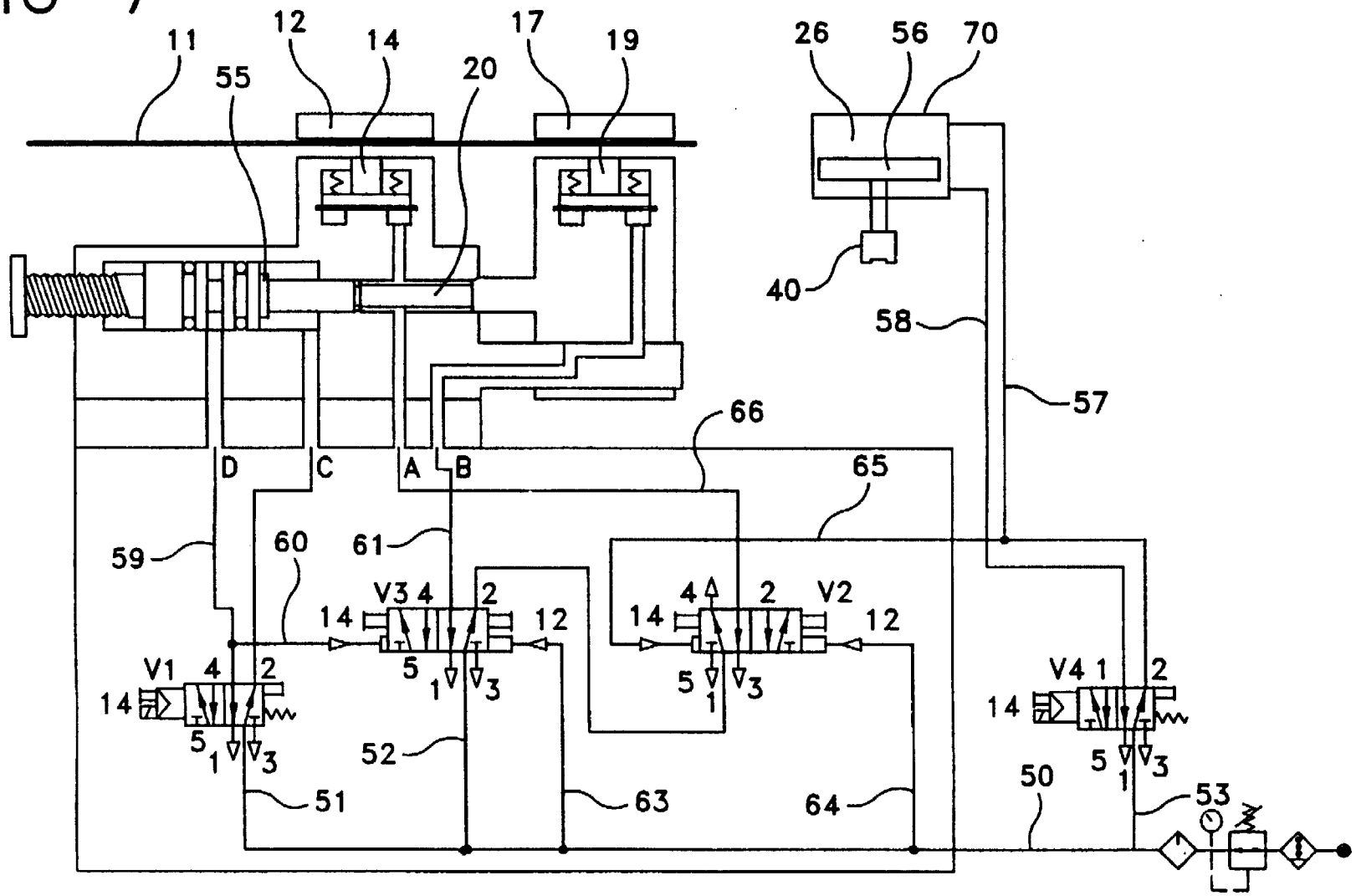
FIG. 7 is a schematic view of the pneumatic circuit for operating the strip feed mechanism of FIGS. 1 to 3.

FIG. 7 shows the strip feed assembly at the start of a cycle, corresponding to the state shown in FIG. 1 of the drawings. Ports A and B connected below the pistons 14 and 19 are exhausted via ports 2 and 3 in V2 and ports 4 and 5 in V3 respectively. Compressed air supplied through V1 enters port C to urge piston 55, and hence the bar 20 and the shuttle 16 to the left in FIG. 7. The piston 56 is depressed by air supply connected through ports 1 and 2 in V4 then through line 57.

Upon adequate movement of the pilot pin 40 into engagement with the strip 11, a switch on the barb cutting and insertion machine which changes state at a particular stage in the operation of that machine alters electrically the state of valves V1 and V4. Adequate movement of the pilot pin 40 is sensed by a sensor (not shown) in cylinder 70 in which the piston 56 travels. The sensor generates an electrical signal as the piston 56 passes the sensor, and the signal will be of extremely short duration when the pilot pin 40 is able to engage the strip 11 and thereby go beyond the signal generating position. However, if the strip 11 is positioned so that the pilot pin 40 cannot engage the cut-out portions of the strip 11, but rather remains in forced contact with the surface of the strip material, the piston 56 remains in a position in the cylinder 70 such that the sensor continues to generate a signal. A timer in the circuit switches off the entire machine, including the barb cutter and inserter and the feed mechanism if the sensor signal lasts more than a predetermined time. Switching of V4 exhausts the chamber above the piston 56 via line 57 and ports 2 and 3 in V4 and feeds compressed air through inlet port 1 and port 4 up line 58 to the chamber below the piston 56 to raise it, the chamber above the piston 56 being exhausted via lines 57 and ports 2 and 3 in V4. Switching of V1 has the following effects:

i) Compressed air is fed via inlet port 1 and port 4 along line 59 to port D and into a chamber to the left of the piston 55 to drive the piston 55, and hence the shuttle 16 to the right in FIG. 7.

ii) Compressed air along branch 60 changes the state of V3 to feed via inlet port 1 and port 4 compressed air to port B via line 61 to raise the piston 19 to clamp the strip 11 to the shuttle strip guide block 17. This is the state shown in FIG. 2.

When a desired strip advancement has been achieved a proximity switch in the barb cutting and insertion machine (not shown) switches the state of V1 and V4 and this has the following effects:

iii) The chamber to the left of the piston 55 is exhausted via line 59 and ports 4 and 5 in V1, and compressed air is fed instead to port C via inlet port 1 and port 2 of V1. Thus the direction of travel of the piston 55 and hence the shuttle 16 is reversed.

iv) The state of valve V3 is switched by compressed air from line 63, which feeds compressed air through inlet port 1 and outlet port 2 in V3 to inlet port 1 in V2. Port B is exhausted through line 61 and ports 4 and 5 to release the shuttle piston 19. V2 has had its state altered from that shown in FIG. 7 from pressure along line 64, pressure along branch line 65 having fallen once V4 had switched. Thus compressed air is fed along line 66 from port 2 in V2 to raise the piston 14 to clamp the strip to the block 12. This corresponds to the situation in FIG. 3, and continues until the cycle is repeated. It will be appreciated that there are alternative control mechanisms possible for this strip feed mechanism, and that modifications and alterations may be made within the scope of the invention defined by the appended claims.

I claim:

1. A feed mechanism for advancing in steps an elongated strip of material having flexure regions at a regular spacing along its length, the feed mechanism comprising:

a means for advancing the strip by a distance corresponding to the spacing between the flexure regions;

a means for locating the strip including a reciprocating pilot pin such that the flexure regions are at a predetermined position relative to the feed mechanism; and a control device for operating the locating means and the advancing means, the control device including a sensor for sensing pilot pin travel, the sensor generating a continuation sensor signal while the pilot pin is at an intermediate position between a fully engaged and fully disengaged position with respect to the strip, the control device further including a timer being responsive to the continuous sensor signal generated when the pilot pin is in the intermediate position, the timer generating a timer signal which turns off the feed mechanism when the duration of the continuous sensor signal exceeds a predetermined period of time.

* * * * *